US011091923B2

(12) United States Patent
Recker et al.

(10) Patent No.: US 11,091,923 B2
(45) Date of Patent: Aug. 17, 2021

(54) BRACE FOR A PRECAST CONCRETE PANEL

(71) Applicant: MEADOW BURKE, LLC, Tampa, FL (US)

(72) Inventors: Michael J. Recker, Palmetto, FL (US); Thomas F. Abbott, Jr., San Antonio, TX (US)

(73) Assignee: MEADOW BURKE, LLC, Tampa, FL (US)

( * ) Notice: Subject to any disclaimer, the term of this patent is extended or adjusted under 35 U.S.C. 154(b) by 0 days.

(21) Appl. No.: 16/433,313

(22) Filed: Jun. 6, 2019

(65) Prior Publication Data

US 2019/0368210 A1 Dec. 5, 2019

Related U.S. Application Data

(63) Continuation-in-part of application No. 29/650,200, filed on Jun. 5, 2018.

(60) Provisional application No. 62/809,138, filed on Feb. 22, 2019.

(51) Int. Cl.
*E04G 21/16* (2006.01)
*E04G 21/26* (2006.01)

(52) U.S. Cl.
CPC ..... *E04G 21/165* (2013.01); *E04G 21/26* (2013.01)

(58) Field of Classification Search
CPC ..... E04G 21/26; E04G 17/14; E04G 25/08; E04G 21/167; E04B 2002/8688
See application file for complete search history.

(56) References Cited

U.S. PATENT DOCUMENTS 1,551,432 A * 8/1925 Schaeffer ..... E04G 25/08 254/134
2,684,824 A * 7/1954 Hillberg ..... E04G 21/26 248/354.5
2,832,559 A 4/1958 Hillberg
3,171,627 A * 3/1965 Tapley ..... E04G 21/26 248/354.3
3,229,950 A * 1/1966 MacRobbie ..... E04G 21/26 248/354.5
3,700,202 A 10/1972 Donnels
3,776,555 A * 12/1973 Hagaman ..... A63B 69/3614 473/221

(Continued)

FOREIGN PATENT DOCUMENTS

CA 2063095 9/1993
GB 2170525 8/1986
WO WO 2009/114902 9/2009

OTHER PUBLICATIONS

"Pipe Braces Brochure," SureBuilt Concrete Forms & Accessories, Mar. 26, 2019, 6 pages [retrieved online from: surebuilt-usa.com/docs/Tilt-Up-Pipe-Braces.pdf].

(Continued)

*Primary Examiner* — Jessie T Fonseca
(74) *Attorney, Agent, or Firm* — Sheridan Ross P.C.

(57) ABSTRACT

An adjustable brace to support a precast concrete panel in a substantially vertical orientation. The adjustable brace includes a first elongate member selectively secured to a second elongate member. The first elongate member can be interconnected to the second elongate member at a job site without significantly decreasing the maximum load that the second elongate member can support.

20 Claims, 5 Drawing Sheets

(56) References Cited

U.S. PATENT DOCUMENTS

| | | | | |
|---|---|---|---|---|
| 3,788,026 | A * | 1/1974 | Cook | E04G 21/26 52/127.2 |
| 3,798,856 | A | 3/1974 | Glaskowski | |
| 3,829,153 | A * | 8/1974 | Fussell, Jr. | B60J 1/20 296/90 |
| 4,083,156 | A | 4/1978 | Tye | |
| 4,872,634 | A | 10/1989 | Gillaspy et al. | |
| 5,114,127 | A * | 5/1992 | Everhart | E04G 21/26 269/41 |
| 5,943,830 | A * | 8/1999 | Truitt | E04G 21/26 248/351 |
| 6,247,273 | B1 * | 6/2001 | Nickel | E04G 17/14 182/230 |
| 6,854,222 | B2 | 2/2005 | Hansort | |
| 8,186,645 | B2 | 5/2012 | Shaw et al. | |
| 8,826,605 | B2 | 9/2014 | Recker et al. | |
| 2003/0131543 | A1 | 7/2003 | Hansort | |
| 2006/0207215 | A1 | 9/2006 | Bruno | |
| 2007/0175174 | A1 | 8/2007 | Bruno | |
| 2009/0057518 | A1 * | 3/2009 | Russell | E04G 21/26 248/354.1 |
| 2011/0047895 | A1 * | 3/2011 | Finch | E04G 21/26 52/126.1 |
| 2011/0079698 | A1 | 4/2011 | Pezzimenti | |
| 2018/0058082 | A1 * | 3/2018 | Hansort | E04G 17/14 |

OTHER PUBLICATIONS

"Tilt-up Technical Manual," MeadowBurke, 2018, MBo418, 126 pages [retrieved online from: www.meadowburke.com/techmanuals/tilt.pdf].

* cited by examiner

BRACE FOR A PRECAST CONCRETE PANEL

CROSS-REFERENCE TO RELATED APPLICATIONS

This application is a continuation-in-part of U.S. patent application Ser. No. 29/650,200 filed Jun. 5, 2018 and entitled "Pre-Cast Panel Wall Brace," and claims priority and benefits under 35 U.S.C. § 119(e) to U.S. Provisional Patent Application Ser. No. 62/809,138 filed Feb. 22, 2019, entitled "Brace for a Precast Concrete Panel," which are each incorporated herein in their entirety by reference.

FIELD

The present invention generally relates to braces for precast or preformed concrete panels. More specifically, the present disclosure relates to braces configured to be attached to a precast concrete panel after the panel has been tilted up to a vertical position.

BACKGROUND

Precast concrete panels provide advantages in quality control and logistics since precast concrete panels can be fabricated in a controlled environment at a manufacturing facility and transported to a job site. At the job site, the panels are erected or tilted up to a substantially vertical orientation by a crane. The panels are then held in place by temporary steel braces. The braces must be of sufficient strength to resist wind loading until permanent structural connections have been made.

Building structures using tilt-up construction methods provides many benefits. For example, tilt-up construction methods typically require less time than other construction methods. Additionally, less forming and placing equipment may be required at the job site than for conventional construction methods. Due to these and other benefits, the size of structures constructed with tilt-up precast concrete panels is increasing. For example, some tilt-up panels have a height of over 90 feet and weigh over 300,000 pounds.

There is a need for braces with increased lengths and sufficient strength to stabilize these panels. Because the braces are typically transported to job sites by trucks on commercial roads, braces exceeding certain lengths are difficult or impossible to transport. Further, long braces take up a large amount of space and are challenging to handle and store. For example, one known brace with a length of approximately 32 feet weighs about 275 pounds.

Some attempts have been made to attach extensions to shorter braces to temporarily increase the length of the brace and thus the height of a panel that can be supported. Unfortunately, known extensions reduce the load the brace can support. For example, 5 foot and 10 foot extensions are available for one known brace having a length of 32 feet. However, the maximum load the 32' brace can support is reduced by 23% when the 5' extension is attached. The maximum load is reduced by an additional 23% when the 10' extension is attached to the 32' brace. More specifically, the 32' brace can support a load of 13.50 kips. When the 5' extension is attached to the 32' brace the maximum load is reduced to 10.36 kips. The 32' brace with the 10' extension can only support 8.04 kips.

Some telescoping braces include sliding members that can be adjusted to alter the length of the brace. However, the loads that can be supported by known telescoping braces also decreases as the length of the brace increases.

Due to these and other limitations of known braces, there is a long felt but unmet need for an adjustable brace comprising a first elongate member that can be interconnected to a second elongate member to increase the length of the brace without significantly decreasing the maximum load that the brace can support.

SUMMARY

One aspect of the present invention is a brace with an adjustable length and which is configured to stabilize a tilt-up precast concrete panel. The brace includes a first elongate member and a second elongate member. The first elongate member can be interconnected to the second elongate member at a job site without significantly decreasing the maximum load that the second elongate member can support.

The first elongate member has a first length and a generally hollow interior defining a chamber. The chamber has an interior width.

The second elongate member has a second length and an exterior surface with an exterior width. The exterior width is not greater than the interior width of the chamber of the first elongate member.

The chamber of the first elongate member has a length sufficient to receive a predetermined portion or percent of the second length of the second elongate member. In one embodiment, the chamber is configured to receive at least approximately one-fifth of the second length of the second elongate member.

The first elongate member is configured to be releasably secured to the second elongate member. Optionally, a locking member can be used to selectively secure the first elongate member to the second elongate member. The locking member can extend transversely through the first and second elongate members. In one embodiment, the locking member is a bolt or a pin. Optionally, the locking member can extend through bores or apertures formed through each of the first and second elongate members.

In one embodiment, the first elongate member can have a first length that is up to approximately 40% of the second length of the second elongate member. Optionally, the first length of the first elongate member is selected to increase the second length of the second elongate member by up to approximately 20% when the first elongate member is interconnected to the second elongate member. Up to approximately 50% of the first length of the first elongate member can overlap the second elongate member when the first elongate member is secured to the second elongate member.

The second elongate member can have a second length of from approximately 40 feet to approximately 60 feet. The first length of the first elongate member is optionally between approximately 15 feet and approximately 25 feet. Accordingly, in one embodiment, when the first elongate member is interconnected to the second elongate member, the brace has a length of from approximately 47 feet to approximately 72 feet. In another embodiment, the brace can have a length of approximately 60 feet.

The first elongate member and the second elongate member can be generally cylindrical. In one embodiment, the first and second elongate members are formed of a metal, such as a steel.

One aspect of the present invention is an adjustable brace configured to support a precast concrete panel in a substantially vertical orientation. The adjustable brace generally includes, but is not limited to, one or more of: (1) a first elongate member having a first length and a generally hollow interior defining a chamber, the chamber having an interior diameter; (2) a second elongate member having a second length and an outer diameter, the interior diameter of the first elongate member being greater than the outer diameter of the second elongate member, and the second elongate member being slidingly receivable in the chamber of the first elongate member to form the adjustable brace with a specific length; (3) a locking member to selectively secure the first elongate member to the second elongate member; (4) a pivotable head interconnected to a first end of the first elongate member, the pivotable head being adapted for engagement with a precast concrete panel that is generally vertically oriented; and (5) a pivotable foot adjustably interconnected to a second end of the second elongate member, the pivotable foot being adapted for engagement with a ground surface that is generally horizontal. In one embodiment, a maximum load that can be supported by the adjustable brace is approximately equal to a maximum load that can be supported by the second elongate member individually. More specifically, in one embodiment, the adjustable brace and the second elongate member can each support a load of approximately 16 kips without buckling, bending, or failing.

Optionally, the first elongate member and the second elongate member each have a generally cylindrical shape with a circular or oval cross-sectional geometry. Alternatively, the first and second elongate members can have a square or rectangular cross-sectional shape.

The first length of the first elongate member can be approximately 40% of the second length of the second elongate member. In one embodiment, when the first elongate member is secured to the second elongate member the specific length of the adjustable brace is approximately 20% greater than the second length. Optionally, approximately 50% of the first length of the first elongate member overlaps the second elongate member when the first elongate member is secured to the second elongate member. In one embodiment, the first length can be up to approximately 20 feet, the second length can be up to approximately 50, and the specific length of the adjustable brace can be between approximately 59 feet and approximately 65 feet.

In one embodiment, the first elongate member is comprised of steel plate. In one embodiment the steel plate is twisted into a cylinder and welded along adjoining edges. The steel plate can be between approximately 0.125 inches and approximately 0.145 inches thick, or approximately 0.131 inches thick and may have a minimum yield strength of at least approximately 40 ksi. In another embodiment, the steel plate has a tensile strength of between approximately 65 and approximately 85 ksi.

The first elongate member optionally has an exterior diameter of between approximately 7 inches and approximately 10 inches. In one embodiment, an interior diameter of the first elongate member is between approximately 6.5 inches and approximately 9.5 inches.

The adjustable brace can optionally include a first plurality of apertures formed through the first elongate member and a second plurality of apertures formed through the second elongate member. A first one of the first plurality of apertures can be aligned with a first one of the second plurality of apertures to receive the locking member. Optionally, the specific length of the adjustable brace can be altered by aligning the first one of the first plurality of apertures with a second one of the second plurality of apertures and positioning the locking member through the aligned apertures.

The adjustable brace can further comprise indicia formed on the second elongate member. The indicia can be adapted to indicate how far a free end of the second elongate member is positioned within the chamber of the first elongate member.

In one embodiment, the pivotable foot extends from the second end of the second elongate member by a length that is adjustable. Optionally, the length that the pivotable foot extends from the second end is up to approximately 36 inches. In one embodiment, the length that the pivotable foot extends from the second end can be adjusted from approximately 1 inch to approximately 36 inches by a user. In this manner, the pivotable foot can be used to adjust the specific length of the adjustable brace.

In one embodiment, the pivotable foot is interconnected to the second end by an adjustment device. The adjustment device is configured to selectively extend out of and withdraw into the second elongate member to alter the specific length of the adjustable brace.

The adjustment device can be a threaded rod. In one embodiment, rotating the pivotable foot in a first direction increases the specific length of the adjustable brace. Alternatively, rotating the pivotable foot in a second direction decreases the specific length of the adjustable brace.

Optionally, the length that the pivotable foot extends from the second end can be adjusted after the pivotable foot is engaged to the ground surface. More specifically, in one embodiment, the pivotable foot is affixed to a first end of a threaded rod. A second end of the threaded rod is extended through a threaded bore of a nut. The second end can then be fed through an aperture through an end cap secured to the second end of the second elongate member until the end cap contacts the nut. The end cap can rest against the nut. The nut is rotatable relative to the end cap. In this manner, rotating the nut in a first direction moves the nut closer to the pivotable foot and allows more of the threaded rod to extend through the end cap thereby decreasing the specific length of the adjustable brace. Alternatively, rotating the nut in a second direction moves the nut away from the pivotable foot, pushing the end cap away from the pivotable foot and withdrawing the threaded rod from the end cap to increase the specific length of the adjustable brace. Accordingly, in this embodiment, the specific length of the adjustable brace can be altered without rotating the second elongate member, the threaded rod, or the pivotable foot.

Additionally, or alternatively, the adjustment device can include a plurality of apertures. The apertures can be oriented approximately perpendicular to a longitudinal axis of the adjustment device. A pin can be positioned through a selected one of the apertures to prevent the adjustment device from withdrawing into the aperture through the end cap secured to the second end.

In one embodiment, a hydraulic piston can be associated with the adjustment device. Pressure in the hydraulic piston can be increased to drive the adjustment device out of the second end of the second elongate member to increase the specific length of the adjustable brace. Alternatively, by releasing pressure from the hydraulic piston the adjustment device can retract into the second elongate member to decrease the specific length.

It is another aspect to provide a method of stabilizing a precast concrete panel, comprising: (1) providing a precast concrete panel; (2) lifting the precast concrete panel into a substantially vertical orientation; (3) providing an adjustable brace having: (a) a first elongate member having a first end with a pivotable head, a first length, and a generally hollow interior defining a chamber with an interior diameter, the pivotable head being adapted for engagement with the precast concrete panel; (b) a second elongate member having a second length, an outer diameter, and a second end adapted for engagement with a generally horizontal surface, the interior diameter of the first elongate member being greater than the outer diameter of the second elongate member, and the second elongate member being slidingly receivable in the chamber of the first elongate member to alter a length of the adjustable brace; and (c) a locking member to selectively secure the first elongate member to the second elongate member; (4) extending the length of the adjustable brace by sliding the second elongate member at least partially out of the chamber of the first elongate member; (5) securing the first elongate member to the second elongate member with the locking member; (6) engaging the pivotable head to the precast concrete panel; and (7) engaging the second end of the second elongate member to the generally horizontal surface such that the precast concrete panel is stabilized in a substantially vertical orientation. In one embodiment, the pivotable head is engaged to the precast concrete panel before the second end of the second elongate member is engaged to the generally horizontal surface. Alternatively, in another embodiment, the second end of the second elongate member is engaged to the generally horizontal surface before the pivotable head is engaged to the precast concrete panel.

In one embodiment securing the first elongate member to the second elongate member includes: (i) aligning apertures through the first elongate member with apertures through the second elongate member; and (ii) extending the locking member through the aligned apertures. The locking member can include a bolt. Optionally, the bolt can include threads to receive a nut. In one embodiment, two bolts are used to selectively secure the first elongate member to the second elongate member.

Optionally, a pivotable foot can be adjustably interconnected to the second end of the second elongate member. The pivotable foot can provide support and prevent unintended or inadvertent movement of the second end relative to the generally horizontal surface. In one embodiment, the pivotable foot engages a fastener or anchor which is secured to the generally horizontal surface. The fastener or anchor can extend through an aperture or slot through the pivotable foot. In one embodiment, the slot extends approximately perpendicular to a longitudinal axis of the adjustable brace. The slot can have an open end extending through a side of the pivotable foot.

In one embodiment, the method includes driving the fastener into the generally horizontal surface. Alternatively, the method may include forming the generally horizontal surface from concrete with the anchor embedded therein. More specifically, the anchor can be cast-in-place and extend from the generally horizontal surface In another embodiment, the method further includes driving a helical anchor into the generally horizontal surface. The second end of the second elongate member can be affixed to a shaft of the helical anchor. In one embodiment, the helical anchor includes at least two helical plates welded to the shaft. Additionally, the helical plates can be formed of steel plate.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more clear from the Detailed Description, particularly when taken together with the drawings.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims may be increased or decreased by approximately 5% to achieve satisfactory results. In addition, all ranges described herein may be reduced to any sub-range or portion of the range.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

Figure 1:
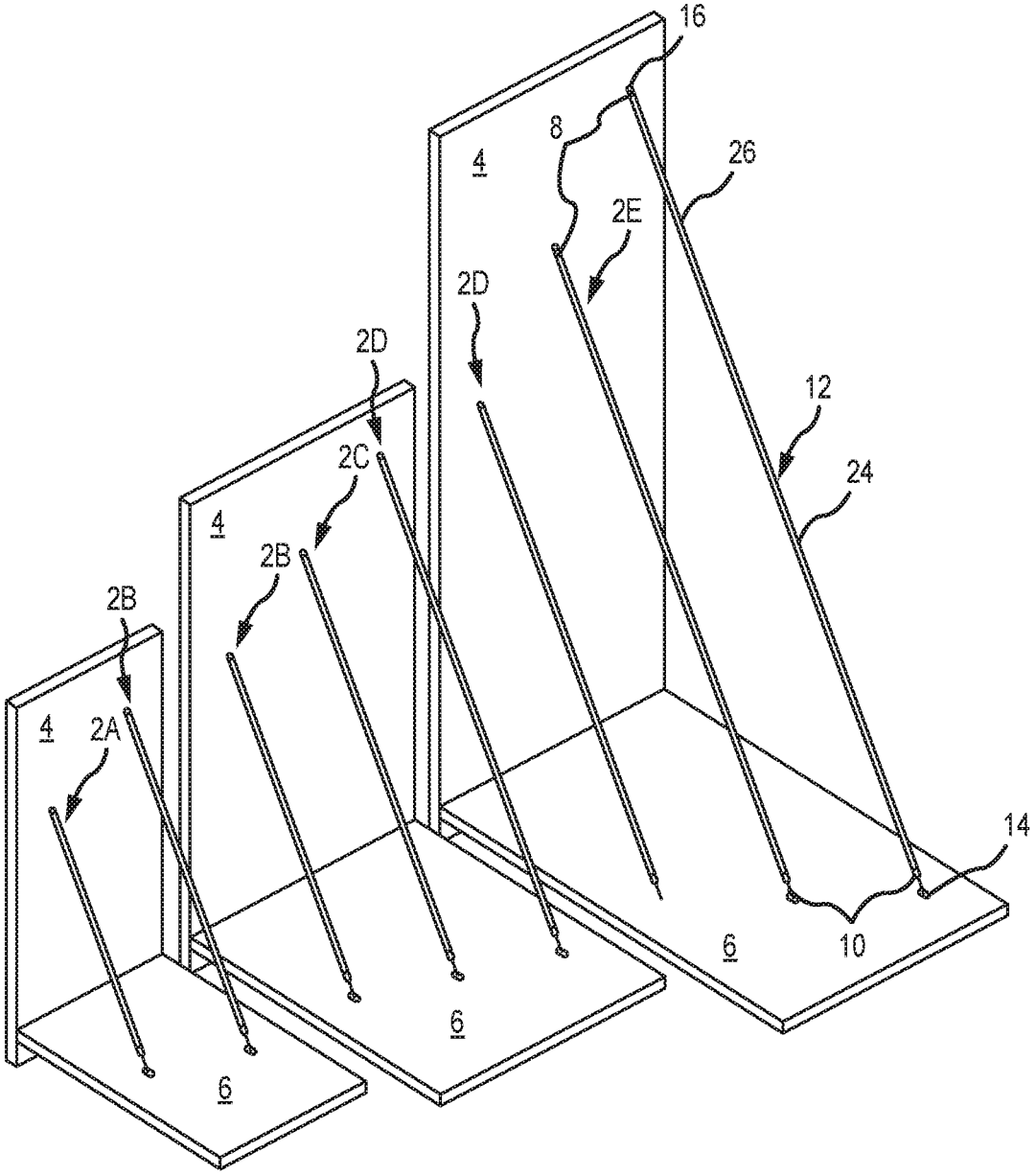
FIG. 1 is a perspective view of a braces of various sizes affixed to tilt-up concrete panels according to one embodiment of the present disclosure.

The drawings are not necessarily to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

The following is a listing of components according to various embodiments of the present disclosure, and as shown in the drawings:

| Number | Component |
|---|---|
| 2 | brace |
| 4 | vertical panel |
| 6 | horizontal slab or ground |
| 8 | first end of brace |
| 10 | second end of brace |
| 12 | brace |
| 14 | second shoe (or foot) |
| 15 | slot |
| 16 | first shoe (or head) |
| 18 | second end cap |
| 20 | first end cap |
| 22 | adjustment device |
| 23 | apertures in the adjustment device |
| 24 | body (or second elongate member) |
| 25 | open end |
| 26 | extension (or first elongate member) |
| 27 | inward projection of extension |
| 28 | connector |
| 29 | outward projection of body |
| 30 | connector |
| 32 | receiver |

-continued

| Number | Component |
|---|---|
| 34 | pin |
| 36 | connector |
| 38 | connector |
| 40 | aperture in body |
| 42 | aperture in extension |
| 43 | indicia |
| 44 | first flange |
| 46 | chamber of extension |
| 48 | length of extension |
| 50 | second flange |
| 52 | helical anchor |
| 54 | shaft |
| 56 | helical plate |
| 58 | length of body |
| 60 | length of brace |

DETAILED DESCRIPTION

Referring now to FIG. 1, a brace 12 according to one embodiment of the present invention is illustrated in comparison to braces 2 of various shorter lengths. The braces are shown affixed to vertical panels 4 and horizontal floor slabs 6. In this manner, the braces 2, 12 support the vertical panels 4, such as precast concrete panels, until permanent connections can be made. The vertical panels 4 and the horizontal panels 6 are depicted at an angle of approximately 90°. However, it will be appreciated that the braces 2, 12 can be used to support the panels 4 oriented at different angles relative to the floor slabs 6. In one embodiment, the angle between the panels and the floor slabs can vary between 15° and 165°. A first end 8 of each brace 2, 12 is removably affixed to the vertical panel 4 and a second end 10 of each brace 2 is removably affixed to the horizontal floor slab 6.

Although the drawing is not to scale, brace 2A has a length of approximately 17 feet with a maximum load of approximately 13 kips. Brace 2B has a length of approximately 22 feet and a maximum load of approximately 11 kips. Similarly, the brace 2C has a length of approximately 32 feet and can support a maximum load of approximately 13.5 kips without buckling. Brace 2D has a length of approximately 42 feet and can support a load of approximately 17.87 kips.

Brace 2E has a length of between approximately 45 feet and 55 feet and a weight of approximately 680 lbs. The brace 2E can support a maximum load of approximately 16.05 kips and the ultimate shoe load is approximately 17.87 kips.

Brace 12 comprises a first elongate member or extension 26 secured to a second elongate member or body 24. The body 24 can be a brace 2E. In one embodiment, the brace 12 has a length that is adjustable between approximately 59 feet and approximately 65 feet, or between approximately 61 feet and approximately 63 feet. The brace 12 is adapted to support at least approximately the same load as brace 2E. More specifically, the brace 12 is configured to support a maximum load of approximately 16.05 kips without buckling. The ultimate shoe load of brace 12 is approximately 17.87 kips. In one embodiment, the extension 26 weighs approximately 270 lbs. Accordingly, the brace 12 may weight approximately 950 lbs.

Referring now to FIGS. 2-9, a brace 12 according to one embodiment of the present invention is generally illustrated. The brace 12 generally comprises a head or first shoe 16, a connector 28, a first end cap 20, an extension 26, a body 24, a second end cap 18, an adjustment device 22, and a foot or second shoe 14. In one embodiment, the body 24 comprises a brace 2E with a length of approximately 52 feet.

The extension 26 is releasably secured to the body 24 by a connector 36. Optionally, two or more connectors 36 can be used to selectively secure the extension 26 to the body 24. The connector 36 can be a bolt, a dowel, a pin, or another suitable connection.

In one embodiment, the extension 26 is a hollow cylindrical tube constructed of high-grade steel. The extension 26 can be formed of steel plate that is cut and welded into a cylindrical tube. In one embodiment, the steel plate is twisted to form the cylindrical tube and then edges of the steel plate are welded together. For example, the weld joining the edges of the steel plate together may follow a generally spiraled or helical pattern. In one embodiment, the extension 26 is formed from steel plate with a thickness of between approximately 0.125 inches and approximately 0.137 inches, or approximately 0.131 inches, and having with a yield strength of between 36 and 44 ksi, or approximately 40 ksi. The extension 26 can optionally be formed of ⅜"×44 ksi steel plate.

Figure 7:
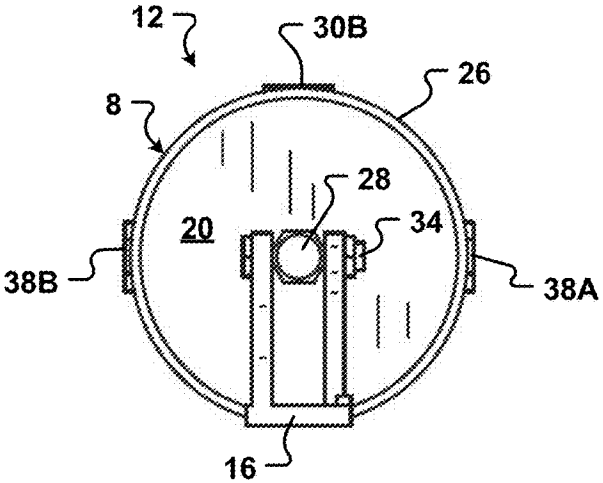
FIG. 7 is an axial or front elevation view of a first end of the brace of FIG. 2.

The first end cap 20 is affixed to the extension 26. Optionally, the first end cap 20 can be welded to the extension 26. Additionally, or alternatively, a connector 38 can be used to connect the first end cap 20 to the extension 26. The connector 38 can be releasably or permanently affixed to the extension 26. In one embodiment, the first end cap 20 includes a first flange 44 (illustrated in FIGS. 4-5) which fits into a chamber 46 formed by a hollow interior of the extension 26. The connector 38 can be a pin or a bolt that extends through apertures formed in the extension 26 and corresponding apertures of the first flange 44. In one embodiment, two connectors 38 are used to connect the first end cap 20 to the extension 26 as generally illustrated in FIG. 7.

In another embodiment, the first end cap 20 is configured to threadably engage the extension 26. For example, in one embodiment, the first flange 44 can include threads adapted to engage internal threads formed within the extension 26.

The first shoe 16 is fixed to the first end cap 20 by the connector 28. A pin 34 can be used to pivotally connect the first shoe 16 to the connector 28. The connector 28 can be configured to space the first shoe 16 a fixed distance from the first end cap 20. Alternatively, the connector 28 can move relative to the first end cap 20 to alter the distance between the first shoe and the first end cap. In one embodiment, the connector 28 is axially adjustable such that the first shoe 16 can rotate relative to the first end cap 20. For example, the connector 28 can include threads that engage a threaded bore through the first end cap 20. Accordingly, the connector 28 can be rotated or screwed relative to the first end cap 20 to alter the distance between the first show 16 and the first end cap. In another embodiment, the connector 28 can include teeth or a ratchet adapted to engage a pawl of the brace 12. Alternatively, in another embodiment, the connector 28 is fixed with respect to the first end cap 20. The connector 28 may be constructed of metal, plastic composite, carbon fiber, or other suitable material.

The extension 26 has a length 48 of between about 5 feet and about 30 feet. In one embodiment, the length of the extension 26 is between about 15 feet and about 25 feet. In another embodiment, the extension length 48 is about 20 feet. When interconnected to the body 24, the extension 26 adds between about 5 feet and about 20 feet to a length 58 of the body 24. In one embodiment, the extension 26 adds between about 8 feet and about 12 feet to the length 58 of the body 24. In another embodiment, the extension 26 increases the length 58 of the body 24 by about 10 feet.

In one embodiment, the extension 26 has a diameter of between about 4 inches and about 15 inches. In another embodiment, the exterior diameter of the extension 26 is between about 6 inches and about 11 inches, or about 8.5 inches. The chamber 46 of the extension has an interior diameter that is greater than an exterior diameter of the body 24. In one embodiment, the interior diameter of the chamber is between about 5 inches and about 10 inches, or about 8.75 inches. The second end cap 18 is fixed to the body 24. Optionally, the second end cap 18 can be welded to the body 24. Alternatively, the second end cap 18 can be releasably connected to the body. The second end cap 18 can include a second flange 50 (illustrated in FIGS. 4-5). The second flange 50 is adapted to be positioned within a hollow interior of the body 24. In one embodiment, a connector 30 can fix the second end cap 18 to the body 24. Optionally, the connector 30 can be permanently affixed to the body 24. Additionally, or alternatively, the connector 30 can be a bolt or a pin that extends through an aperture of the body 24 and a corresponding aperture formed through the second flange 50 of the second end cap 18. In one embodiment, two connectors 30 are used to fix the second end cap 18 to the body 24 as generally illustrated in FIG. 5.

Additionally, or alternatively, the second end cap 18 can be configured to threadably engage the body 24. For example, in one embodiment, the second flange 50 can include threads adapted to engage internal threads formed within the body 24. The second end cap 18 may be constructed of a metal, a plastic composite, a carbon fiber, or other suitable materials.

In one embodiment, the second end cap 18 is connected to the second shoe 14 by the adjustment device 22. A receiver 32 can engage with the adjustment device 22 and alter the position of the adjustment device relative to the second end cap 18. The receiver 32 may be aligned with an aperture formed through the end cap 18. In one embodiment, the receiver 32 includes a female threaded connection. The female threads of the receiver 32 can be configured to engage male threads formed on an exterior of the adjustment device 22.

The adjustment device 22 is operably engaged to the receiver 32 and the second end cap 18. The adjustment device 22 can selectively extend into or out of the receiver 32 and through the second end cap 18 to adjust the length 60 of the brace 12. Optionally, the adjustment device 22 is configured to adjust the length 60 of the brace 12 by up to approximately 3 feet.

Figure 8A:
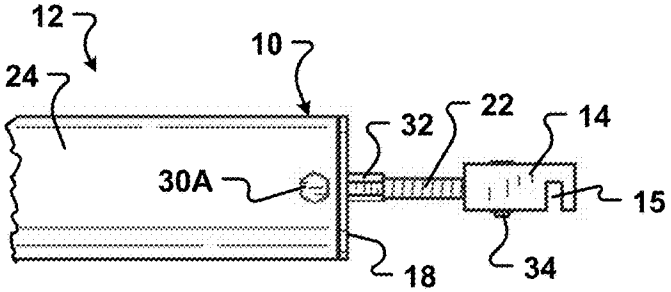
FIG. 8A is a top plan view of a portion of the brace of FIG. 2 and illustrating an adjustment device extending a first distance from a second end cap affixed to a second end of the brace.
Figure 8B:
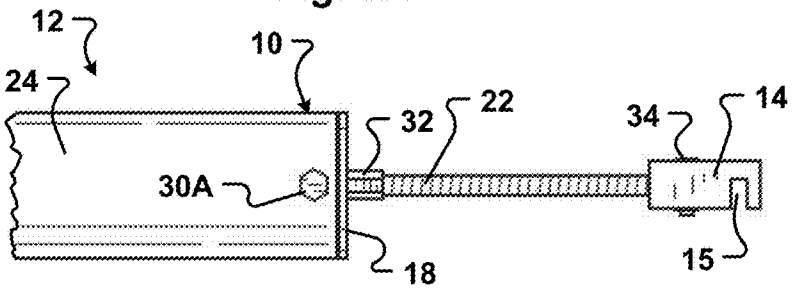
FIG. 8B is another top plan view similar to FIG. 8A and showing the adjustment device extending a second greater distance from the second end cap of the brace.

Referring now to FIGS. 8A-8B, in one embodiment, the receiver 32 is a nut or bolt. The nut 32 can be compressed against the second end cap 18 when a force is applied to the second shoe 14. The nut 32 can threadably engage the adjustment device 22. In this manner, rotating the nut 32 will cause the adjustment device 22 to move into or out of the hollow interior of the body 24 to alter the length 60 of the brace 12 without the need to rotate the second shoe 14 or the body 24.

For example, the nut 32 can be rotated in a first direction to decrease the length of a portion of the adjustment device 22 extending outwardly from the second end cap 18 to shorten the length of the brace 12 as generally illustrated in FIG. 8A. Similarly, rotating the nut 32 in a second direction can increase the portion of the adjustment device 22 extending outwardly from the second end cap 18 to increase the length of the brace as generally shown in FIG. 8B.

In one embodiment, the adjustment device 22 is threaded rod. The threaded rod 22 and the nut 32 facilitate fine adjustment of the length 60 of the brace 12. The adjustment device 22 may be constructed of metal (such as a steel), plastic composite, carbon fiber, or other suitable material.

Optionally, a hydraulic piston can be associated with the adjustment device 22. Pressure can be added to the hydraulic piston to force the adjustment device 22 out of the body 24 through the second end cap 18 and increasing the length of the brace 12 as shown in FIG. 8B. By releasing pressure from the hydraulic piston the adjustment device can withdraw into the body 24 to decrease the brace length as shown in FIG. 8A.

A pump can be used to increase the pressure in the hydraulic piston. In one embodiment, the pump can be powered manually. Additionally, or alternatively, the pump can be powered by a motor. The hydraulic ram may include a valve to release pressure. In one embodiment, the hydraulic piston is positioned within the body 24. Alternatively, the hydraulic piston can be position outside of the body 24.

Figure 8C:
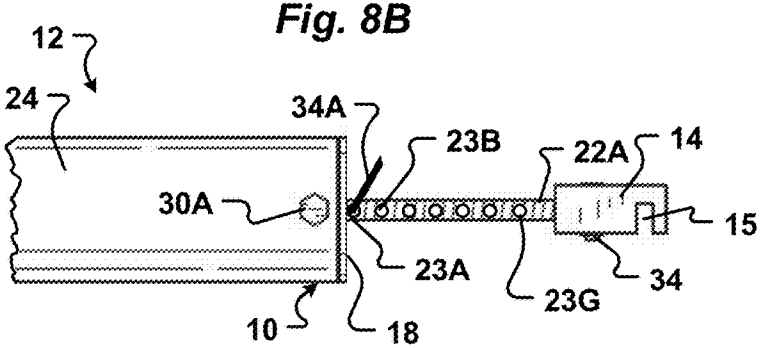
FIG. 8C is still another top plan view of a portion of the brace of FIG. 2 and showing another embodiment of an adjustment device including a plurality of apertures that can receive a pin to adjust the distance between the second end cap and a pivotable foot interconnected to the adjustment device.

Referring now to FIG. 8C, additionally, or alternatively, the adjustment device 22A can include a plurality of apertures 23 adapted to receive a pin 34A. The second end cap 18 can rest against the pin 34A when the second end 10 of the brace 12 is lower than the brace first end 8 (as generally illustrated in FIG. 1). In this manner, the length 60 of the brace 12 can be increased by placing the pin 34A through a first one of the apertures 23A which is distal to the second shoe 14. Similarly, a user can shorten the length 60 of the brace 12 by placing the pin 34A through a second one of the apertures 23G formed proximate to the second shoe 14.

The apertures 23 can be formed through the adjustment device 22A and oriented substantially perpendicular to a longitudinal axis of the brace 12. Although seven apertures 23A-23G are illustrated in FIG. 8C, the adjustment device 22A can include any number of apertures.

For example, the adjustment device 22A can optionally include from 2 to 30 apertures 23. The apertures can have any desired spacing. In one embodiment, the apertures 23 have a substantially even spacing.

The second shoe 14 is configured to releasably connect the brace 12 to the ground or a horizontal slab 6. In one embodiment, the second shoe 14 can include an aperture or slot 15 to receive a fixture secured to the ground or horizontal slab 6. The slot 15 can have an open end. Optionally, the slot is oriented approximately perpendicular to a longitudinal axis of the brace 12. Although not illustrated, the first shoe 16 can also include a slot 15.

The second shoe 14 can be pivotally connected to the adjustment device 22. In one embodiment, the second shoe 14 includes a pin 34 which connects the adjustment device 22 to the second shoe 14. The pin 34 allows the adjustment device 22 to pivot from 0° to 180° in relation to the shoe 14.

Figure 9:
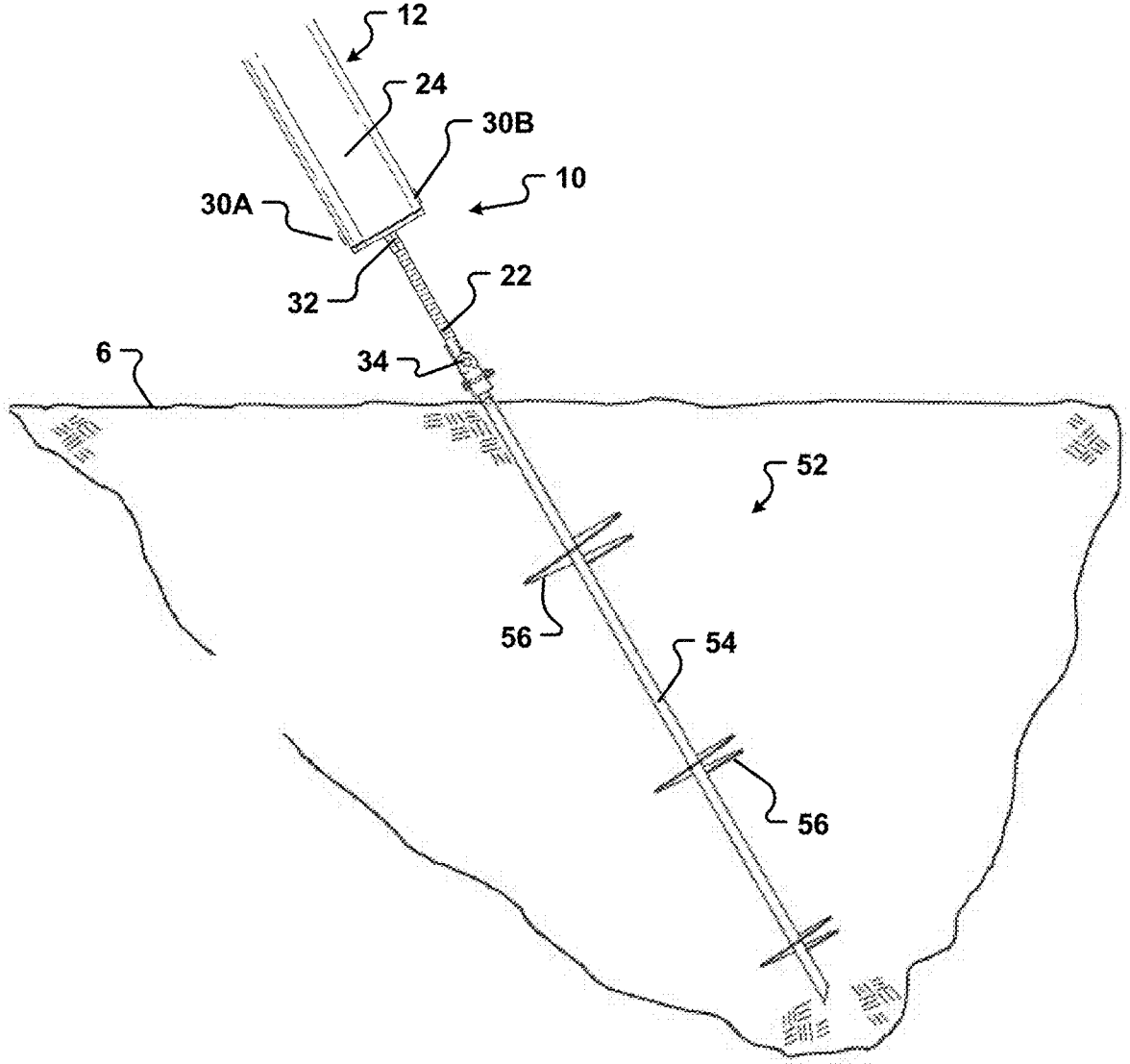
FIG. 9 is a partial side elevation view of a second end of the brace of FIG. 2 interconnected to an optional helical anchor embedded in the ground.

Alternatively, and referring now to FIG. 9, a helical anchor 52 can be interconnected to the adjustment device 22. The helical anchor 52 is adapted to be driven into the ground 6. For example, the helical anchor 52 can include one or more helical plates 56 welded to a shaft 54. The helical plates 56 generally spiral around portions of the helical anchor. When the helical anchor 52 is rotated, the helical plates 56 can engage the ground 6 and pull the helical anchor into the ground.

In one embodiment, the body 24 of the brace 12 is a rod or cylinder. The body 24 may be referred to as the "inner-pipe" or as the "long-pipe." In one embodiment, the body 24 is a hollow cylindrical tube constructed of a metal, such as a high-grade steel. The body 24 can be formed of steel plate that is cut and welded into a cylindrical tube. The steel plate can be twisted into the cylindrical tube and the edges of the plate can be welded together. In one embodiment, the body 24 is formed of a thicker piece of steel than the extension 26. For example, in one embodiment the body 24 is formed from steel plate with a thickness of approximately 0.148 inches and having a yield strength of approximately 40 ksi. Alternatively, in another embodiment, the body 24 can be formed of ⅜"×44 ksi steel plate.

The body 24 has a length 58 that can be between about 15 feet and about 70 feet. In one embodiment, the length 58 of the body 24 is between about 50 feet and 55 feet. In another embodiment, the body length 58 is about 52 feet.

The body 24 can have an exterior diameter of between about 3 inches and about 12 inches. In one embodiment, the exterior diameter of the body 24 is between about 6 inches and about 10 inches. In another embodiment, the body exterior diameter is between about 8 inches and about 9 inches.

Figure 2:
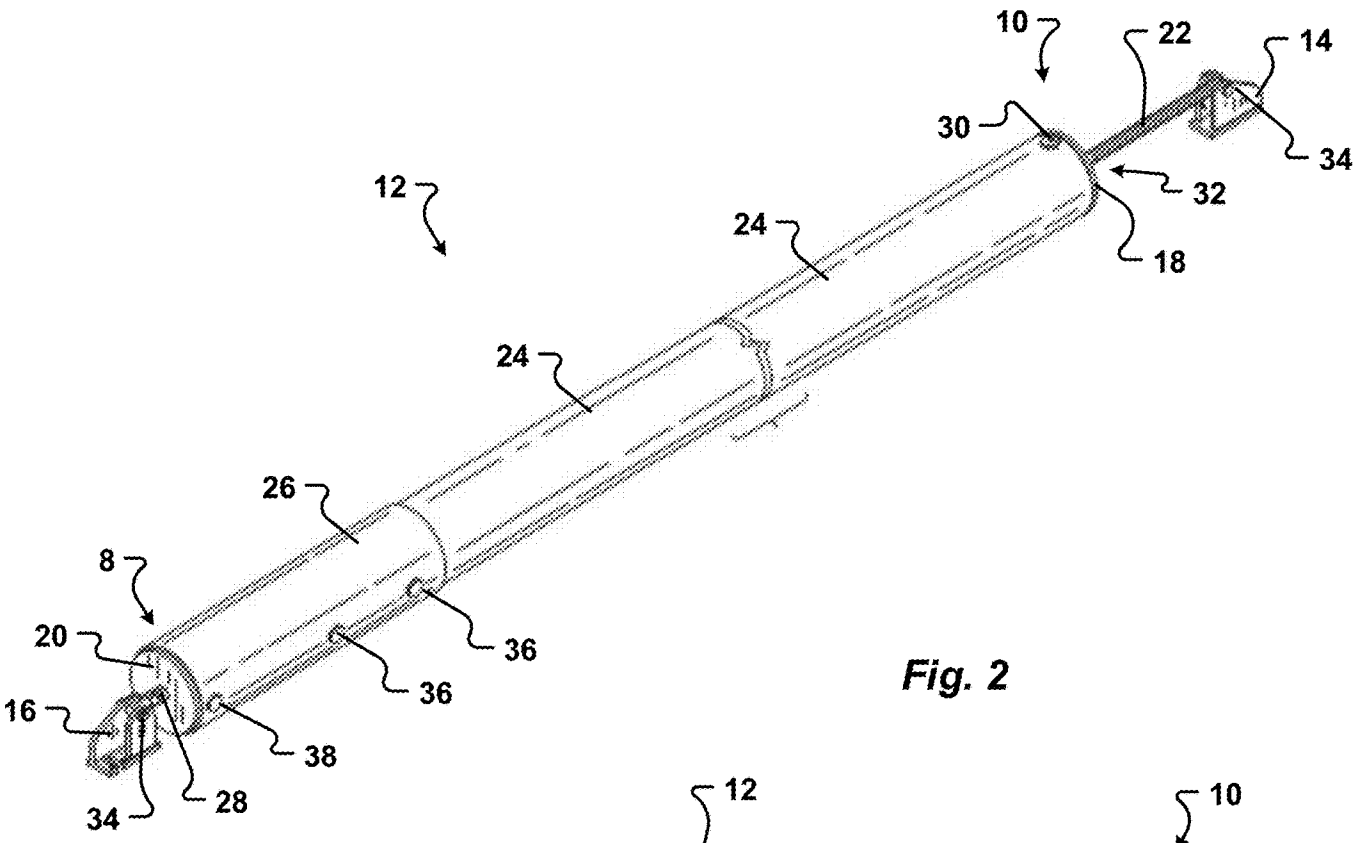
FIG. 2 is a perspective view of a brace according to one embodiment of the present disclosure.
Figure 3:
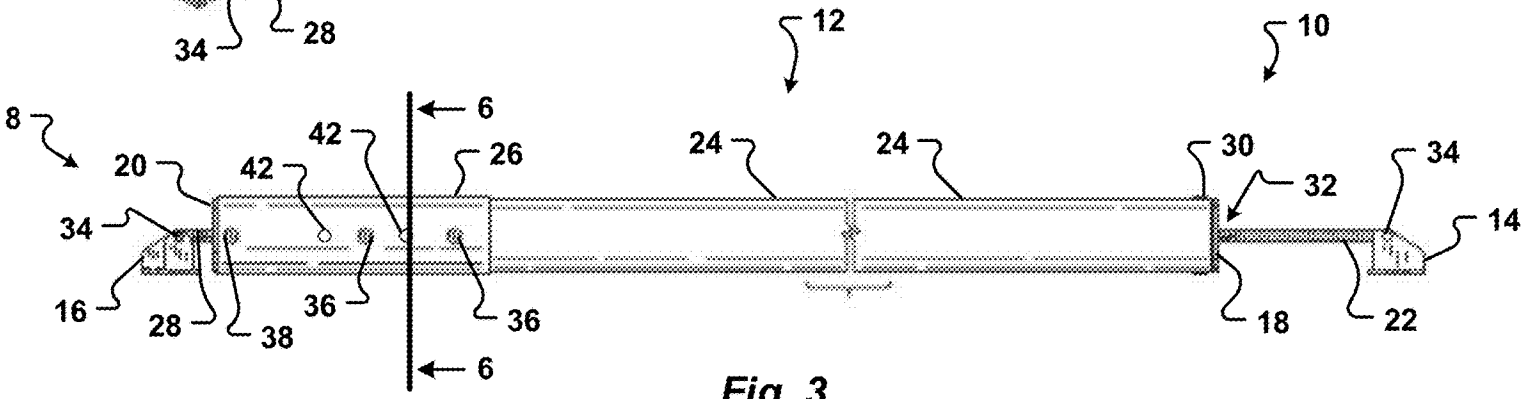
FIG. 3 is a side elevation view of the brace of FIG. 2.
Figure 4:
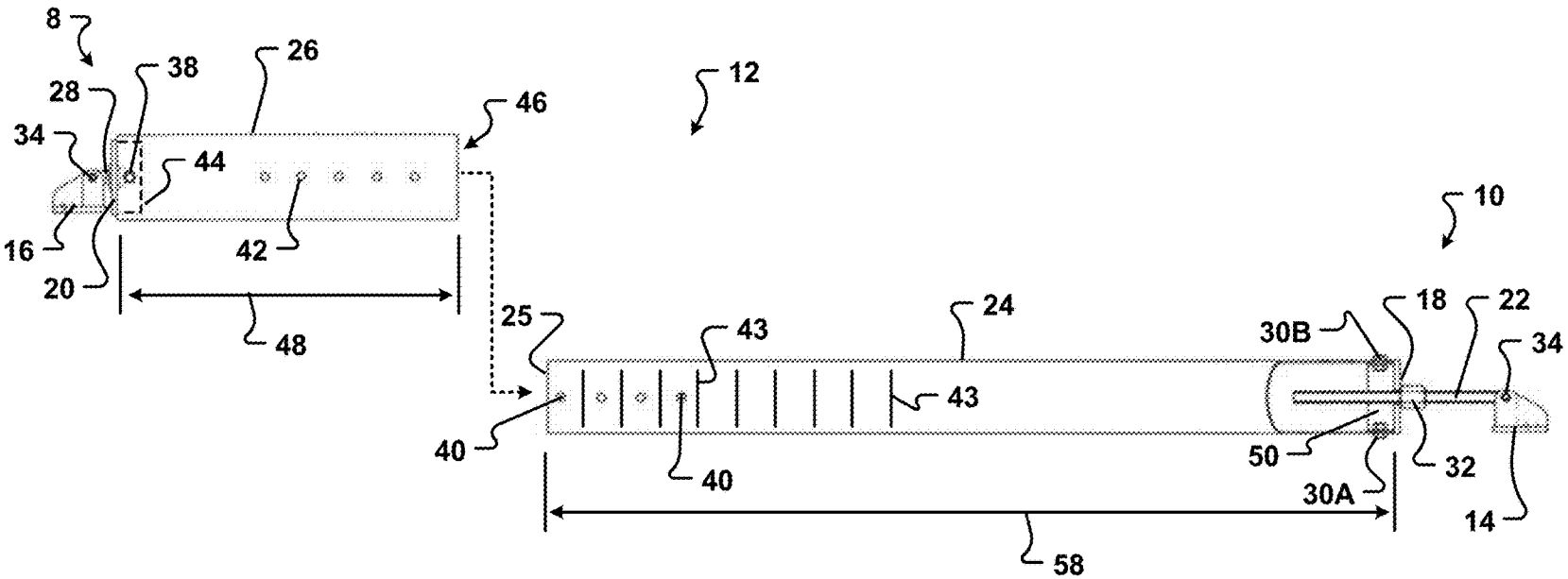
FIG. 4 is a partially exploded side elevation view of the brace of FIG. 2 with some elements of the brace illustrated in hidden lines.
Figure 5:
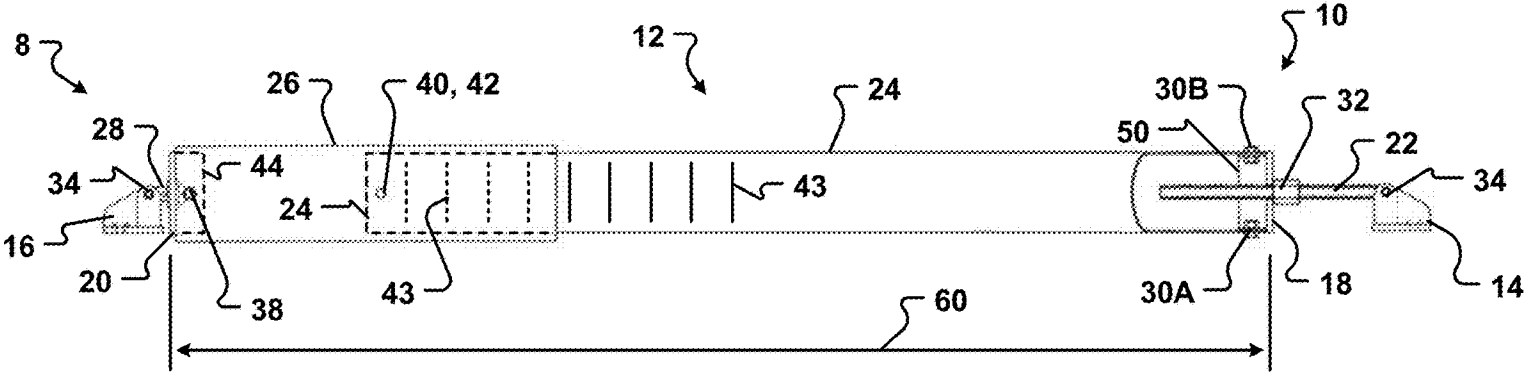
FIG. 5 is another side elevation view of the brace of FIG. 4 showing the brace in an assembled configuration similar to FIG. 3.

Referring now to FIG. 4, the brace 12 is shown in a disassembled state with the body 24 and the extension 26 shown separated. The body 24 includes at least one hole or aperture 40 proximate to an end of the body 24. The extension 26 includes at least one aperture 42 that can be aligned with the aperture 40 of the body. The apertures 40, 42 can be used to attach the extension 26 to the body 24 with a connector, such as connector 36, as generally illustrated in FIGS. 2-3. The connector 36 may be a bolt, a dowel, or a pin, that passes through the aperture 42 and the aperture 40. Optionally, one or more of the extension 26 and the body 24 can include a plurality of apertures 42, 44 which can be aligned. In this manner, the length 60 of the brace 12 can be incrementally adjusted. The body 24 can include any number of apertures 40, for example from 2 to 20 apertures 40. Optionally, the extension 26 can include from 2 to 20 apertures 42. In one embodiment, the body 24 and extension 26 can includes the same number, or a different number, of apertures 40, 42, respectively.

Figure 6:
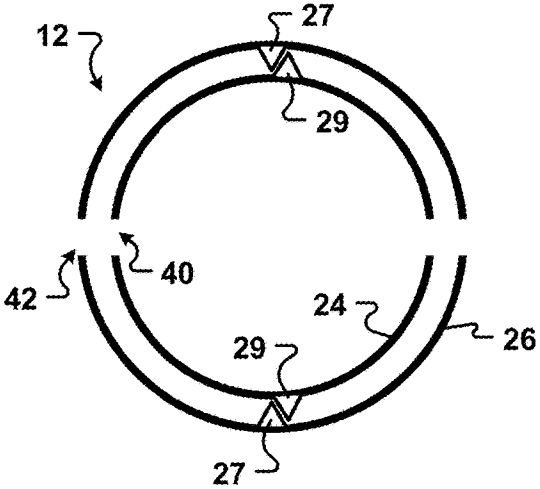
FIG. 6 is a longitudinal cross-sectional view through the brace along line 6-6 of FIG. 3.

Referring now to FIG. 6, in one embodiment, the brace 12 is configured to prevent rotation of the extension 26 relative to the body 24. In this manner, the body apertures 40 can be aligned with the extension apertures 42 to receive a connector 36. In one embodiment, the extension 26 has an alignment feature 27 that engages an alignment feature 29 of the body 24 to prevent rotation of the extension relative to the body. The alignment feature 27 of the extension can extend inwardly from an interior surface of the extension. Similarly, the alignment feature 29 of the body 24 can extend outwardly from an exterior surface of body. The alignment features 27, 29 are configured to contact each other to prevent the relative rotation of the body 26 to the extension 26.

Additionally, or alternatively, in another embodiment the extension 26 can be configured to rotate relative to the body 24 to alter the length of the brace 12. For example, the chamber 46 of the extension 26 can include threads which engage threads formed on an exterior surface of the body 24.

Referring against to FIG. 4, the body 24 can optionally include indicia 43 configured to indicate the amount of the body 24 positioned within the chamber 46 of the extension 26. For example, the indicia 43 can be used to select how far the open end 25 of the body 24 is inserted into the chamber 46 of the extension 26. The indicia 43 can be a line or other mark oriented approximately perpendicular to a longitudinal axis of the body 24 and formed on an exterior surface of the body. In this manner, a user can select a length 60 of the brace 12 by aligning the open end of the extension 26 with one of the lines 43.

Any number of indicia 43 can be formed on the body 24. In one embodiment, the indicia 43 are spaced apart by a predetermined distance. The predetermined distance separated adjacent indicia can from approximately 1 inch to approximately 6 inches.

Referring now to FIG. 5, the body 24 and the extension 26 are shown connected to form the brace 12 with a length 60. In one embodiment, approximately one-half of the length 48 of the extension 26 overlaps the body 24 when connected to form the brace 12. Additionally, or alternatively, the extension 26 can overlap the body 24 by about 10 feet. The length 60 of the brace 12 can be between about 47 feet and about 72 feet. In one embodiment, the brace 12 has a length 60 that is adjustable between about 59 feet and about 65 feet, or between about 61 feet and about 63 feet. In another embodiment, the length 60 of the brace 12 is about 60 feet.

Full size production braces 12 of embodiments of the present invention have been tested in tension and compression to determine their failure loads. The testing determined that the brace 12 including the body 24 and extension 26 has the same load capacity as a brace comprising only the body 24 when assembled as described herein. Accordingly, the additional length provided by the extension 26 to the length 58 of the body 24 does not result in the brace 12 losing any load capacity. The brace 12 with the extension 26 can support a load of at least approximately 16 kips without buckling. Accordingly, the brace 12 can support a load substantially the same as the 52' brace 2E described in conjunction with FIG. 1. The brace 12 also complies to American Society of Civil Engineers (ASCE) 37-02 ("Design Loads on Structures During Construction") and ASCE 7-10 ("Minimum Design Loads for Buildings and Other Structures") regarding basic wind speeds. In order to achieve design and test load strengths, the second end 10 of the brace 12 is anchored to a floor slab 6, such as a concrete floor slab, a footing, a deadman, or a helical anchor 52 having sufficient area, weight, and strength to resist the applied brace loads. The first shoe 16 of the first end 8 is attached to a vertical panel 4 such as generally illustrated in FIG. 1. The first shoe 16 can be attached to a brace insert or another anchor device embedded in the vertical panel.

While various embodiments of the system have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

To provide additional background, context, and to further satisfy the written description requirements of 35 U.S.C. § 112, the following references are incorporated by reference herein in their entireties: U.S. Pat. Nos. 2,832,559; 3,700,202; 3,798,856; 4,083,156; 4,872,634; 6,854,222; 8,186,645; 8,826,605; U.S. Pat. App. Pub. 2003/0131543; U.S. Pat. App. Pub. 2006/0207215; U.S. Pat. App. Pub. 2007/0175174; U.S. Pat. App. Pub. 2011/0079698; Canadian Patent Pub. CA2063095, U.K. Patent App. Pub. GB2170525, and PCT Pub. WO 2009/114902. Additional description and support is provided by: "Tilt-Up Technical Manual" which is published by Meadow Burke, copyright 2018, and is available at http://www.meadowburke.com/techmanuals/tilt.pdf.

What is claimed is:

1. An adjustable brace configured to support a precast concrete panel in a substantially vertical orientation, comprising:

a first elongate member having a first end and an opposite second end, a first length, an exterior diameter, and a generally hollow interior defining a chamber having an interior diameter, wherein the exterior diameter at the first end is equal to the exterior diameter at the second end of the first elongate member;

a second elongate member having a second length and an outer diameter, wherein the first length of the first elongate member is approximately 40% of the second length of the second elongate member, wherein the interior diameter of the first elongate member is greater than the outer diameter of the second elongate member, and wherein the second elongate member can be slidingly received in the chamber of the first elongate member to form an adjustable brace with a specific length;

a locking member to selectively secure the first elongate member to the second elongate member;

a pivotable head interconnected to the first end of the first elongate member, wherein the pivotable head is adapted for engagement with a precast concrete panel that is generally vertically oriented;

a pivotable foot adjustably interconnected to a second end of the second elongate member, wherein the pivotable foot is adapted for engagement with a surface that is generally horizontal; and wherein a maximum load that can be supported by the adjustable brace is approximately equal to a maximum load that can be supported by the second elongate member.

2. The adjustable brace of claim 1, wherein the adjustable brace and the second elongate member can each support a load of approximately 16 kips without buckling.

3. The adjustable brace of claim 1, wherein the first elongate member and the second elongate member each have a generally cylindrical shape.

4. The adjustable brace of claim 1, wherein when the first elongate member is secured to the second elongate member the specific length of the adjustable brace is approximately 20% greater than the second length.

5. The adjustable brace of claim 1, wherein approximately 50% of the first length of the first elongate member overlaps the second elongate member when the first elongate member is secured to the second elongate member.

6. The adjustable brace of claim 1, wherein the first length is approximately 20 feet, the second length is approximately 50 feet, and the specific length of the adjustable brace is between approximately 59 feet and approximately 65 feet.

7. The adjustable brace of claim 1, wherein the first elongate member is comprised of steel plate that is twisted into a cylinder and welded along adjoining edges.

8. The adjustable brace of claim 7, wherein the steel plate is approximately 0.131 inches thick and has a minimum yield strength of at least approximately 40 ksi, and wherein the steel plate has a tensile strength of between approximately 65 and approximately 85 ksi.

9. The adjustable brace of claim 1, wherein the outer diameter of the second elongate member is approximately constant from the second end to an opposite open end.

10. The adjustable brace of claim 1, wherein the exterior diameter of the first elongate member is between approximately 7 inches and approximately 10 inches and the interior diameter is between approximately 6.5 inches and approximately 9.5 inches.

11. The adjustable brace of claim 1, further comprising a first plurality of apertures formed through the first elongate member and a second plurality of apertures formed through the second elongate member, wherein a first one of the first plurality of apertures is alignable with a first one of the second plurality of apertures to receive the locking member.

12. The adjustable brace of claim 11, wherein the specific length of the adjustable brace can be altered by aligning the first one of the first plurality of apertures with a second one of the second plurality of apertures and positioning the locking member through the aligned apertures, and further comprising indicia formed on the second elongate member that are adapted to indicate how far an open end of the second elongate member is positioned within the chamber of the first elongate member.

13. The adjustable brace of claim 1, further comprising a threaded rod to interconnect the pivotable foot to the second end of the second elongate member, wherein the threaded rod is configured to selectively extend out of and withdraw into the second elongate member to alter the specific length of the adjustable brace.

14. The adjustable brace of claim 1, further comprising a first end cap affixed to the first end of the first elongate member, wherein the pivotable head is interconnected to the first end cap.

15. The adjustable brace of claim 14, wherein the first end cap includes a first flange that fits into the chamber.

16. The adjustable brace of claim 1, further comprising a second end cap affixed to the second end of the second elongate member, wherein the pivotable foot is interconnected to a threaded rod that extends through an aperture through the second end cap.

17. A brace configured to support a precast concrete panel in a substantially vertical orientation, comprising:

a metal body with a cross sectional shape that is approximately circular and including: a first end with a first exterior diameter, a second end with the first exterior diameter, a first length from the first end to the second end, a first end cap affixed to the first end, a threaded rod extending through an aperture in the first end cap, a foot pivotably interconnected to the threaded rod, wherein the metal body can support a maximum load; and a metal extension with a cross-sectional shape that is approximately circular and that includes: an upper end with a second exterior diameter, an open end with the second exterior diameter, a second length from the upper end to the open end, a second end cap affixed to the upper end, a head pivotably interconnected to the second end cap, a chamber extending to the open end to receive the second end of the metal body, wherein the second length is approximately 40% of the first length, wherein the metal extension is secured to the metal body with at least approximately one-fifth of the metal body positioned in the chamber, and wherein the metal body with the metal extension can support the maximum load.

18. An adjustable brace configured to support a precast concrete panel in a substantially vertical orientation, comprising:

a first elongate member having a first end and an opposite second end, a first length, and a generally hollow interior defining a chamber having an interior diameter, wherein the first end and the second end of the first elongate member have exterior diameters that are equal;

a second elongate member having a second length and an outer diameter, wherein the interior diameter of the first elongate member is greater than the outer diameter of the second elongate member, and wherein the second elongate member can be slidingly received in the chamber of the first elongate member to form an adjustable brace with a specific length, wherein the first length is approximately 20 feet, the second length is approximately 50 feet, and the specific length of the adjustable brace is between approximately 59 feet and approximately 65 feet;

a locking member to selectively secure the first elongate member to the second elongate member;

a pivotable head interconnected to the first end of the first elongate member, wherein the pivotable head is adapted for engagement with a precast concrete panel that is generally vertically oriented; and a pivotable foot adjustably interconnected to a second end of the second elongate member, wherein the pivotable foot is adapted for engagement with a surface that is generally horizontal.

19. The adjustable brace of claim 18, wherein the first elongate member and the second elongate member each have a generally cylindrical shape.

20. The adjustable brace of claim 18, wherein approximately 50% of the first length of the first elongate member overlaps the second elongate member when the first elongate member is secured to the second elongate member.

* * * * *